US011384578B2

(12) United States Patent
Lee

(10) Patent No.: US 11,384,578 B2
(45) Date of Patent: Jul. 12, 2022

(54) OVEN DOOR HINGE

(71) Applicant: SEO WON KOREA CO., LTD., Gimhae-si (KR)

(72) Inventor: Juneyoung Lee, Gimhae-si (KR)

(73) Assignee: SEO WON KOREA CO., LTD., Gimhae-si (KR)

( * ) Notice: Subject to any disclaimer, the term of this patent is extended or adjusted under 35 U.S.C. 154(b) by 0 days.

(21) Appl. No.: 16/960,531

(22) PCT Filed: Dec. 13, 2018

(86) PCT No.: PCT/KR2018/015824
§ 371 (c)(1),
(2) Date: Jul. 7, 2020

(87) PCT Pub. No.: WO2019/139262
PCT Pub. Date: Jul. 18, 2019

(65) Prior Publication Data

US 2020/0370351 A1 Nov. 26, 2020

(30) Foreign Application Priority Data

Jan. 12, 2018 (KR) ..... 10-2018-0004677

(51) Int. Cl.
*E05D 11/06* (2006.01)
*E05D 5/06* (2006.01)
*F24C 15/02* (2006.01)

(52) U.S. Cl.
CPC ..... *E05D 11/06* (2013.01); *E05D 5/06* (2013.01); *F24C 15/02* (2013.01); *F24C 15/023* (2013.01)

(58) Field of Classification Search
CPC ..... F24C 15/023; E05D 5/06; E05D 5/065; E05D 2005/067; E05D 11/06
See application file for complete search history.

(56) References Cited

U.S. PATENT DOCUMENTS 2,178,271 A * 10/1939 Soss ..... E05D 3/186 16/358
2,198,346 A * 4/1940 Little ..... F24C 15/023 126/191
2,608,713 A * 9/1952 Soss ..... E05D 3/186 16/337
2,727,507 A * 12/1955 Titus ..... F24C 15/023 126/191

(Continued)

*Primary Examiner* — Jeffrey O'Brien
(74) *Attorney, Agent, or Firm* — Goldilocks Zone IP Law

(57) ABSTRACT

Present invention is related to a door hinge for opening and closing a door, the door hinge including: a fixing member fixed to the door frame of the oven range; an operating frame that is rotatably connected to the fixing member and is fixed to the door to open and close the door; a hinge bracket configured to rotatably connecting the operating frame to the fixing member, wherein the hinge bracket includes: a plate connected with the inside of the lower end of the operating frame, and a gap holding member having a first end, a second end, and in a shape of a "⊏" at the center thereof for forming a space, wherein the first end of the gap holding member is connected to a lower end of the plate, and the second end of the gap holding member is connected to lower end of the fixing member.

1 Claim, 4 Drawing Sheets

(56) References Cited

U.S. PATENT DOCUMENTS 2,731,011 A * 1/1956 Maier ..... F24C 15/023 126/191
2,780,219 A * 2/1957 Pollock ..... F24C 15/023 126/194
2,823,661 A * 2/1958 Grannan ..... F24C 15/023 126/191
2,842,117 A * 7/1958 Berge ..... F24C 15/023 126/194
2,845,923 A * 8/1958 Nelson ..... F24C 15/023 126/191
3,327,701 A * 6/1967 Smith ..... F24C 15/023 126/194
3,820,866 A * 6/1974 Kaldenberg ..... E05F 5/08 312/276
4,163,344 A * 8/1979 Scherer ..... F24C 15/023 49/386
5,341,542 A * 8/1994 Hannan ..... A47B 46/005 126/194
5,485,656 A * 1/1996 Domenig ..... E05D 5/065 16/248
6,968,597 B2 * 11/2005 Habegger ..... E05D 11/1064 126/194
6,986,187 B2 * 1/2006 Cummins ..... E05F 1/1276 16/286
7,017,232 B1 * 3/2006 Priddy ..... E05F 1/1276 16/286
7,755,004 B2 * 7/2010 Collene ..... F24C 15/023 219/391
8,533,914 B2 * 9/2013 Vanini ..... E05F 1/1261 16/286
9,625,160 B2 * 4/2017 Xiao ..... E05D 3/02
9,874,354 B2 * 1/2018 Jadhav ..... E05F 1/1261
9,881,443 B2 * 1/2018 Maher ..... G07F 17/3216
10,633,904 B2 * 4/2020 Elkasevic ..... F24C 15/023
10,641,027 B2 * 5/2020 Lee ..... E05F 5/02
10,890,334 B2 * 1/2021 White ..... E05F 5/02
10,907,389 B2 * 2/2021 White ..... F24C 15/02
2007/0209654 A1 * 9/2007 Wang ..... F24C 15/023 126/194
2011/0316401 A1 * 12/2011 Cummins ..... E05F 1/1075 312/319.2
2019/0353352 A1 * 11/2019 Hong ..... F24C 15/04

* cited by examiner

OVEN DOOR HINGE

CROSS-REFERENCE TO RELATED APPLICATIONS

This application claims the benefit under 35 U.S.C. § 371, of PCT International Application No.: PCT/KR2018/015824, filed on Dec. 13, 2018, which claims foreign priority to Korean Patent Application No.: 10-2018-0004677, filed on Jan. 12, 2018, in the Korean Intellectual Property Office, both of which are hereby incorporated by reference in their entireties.

TECHNICAL FIELD

The present invention relates to a door hinge, and, more specifically, a door hinge for an oven that can positioned lower than an interior floor of the oven when the door hinge is completely opened forward.

BACKGROUND OF INVENTION

In general, there are two different types of door hinges, one type is the door can be opened and closed hinged by one side and the other type is the door is opened and closed upper and lower side hinged by an upper side, i.e., a side closing type door and a top closing type door.

In the meantime, the latter is used for the door of a gas oven range or a microwave oven for home appliance. It shows in FIG. 1 in which the conventional composition of the door hinge is attached.

As it is well known, a door hinge is a device designed to allow the door to perform opening and closing from the door frame. These door hinges can be divided into a left-right opening and closing method wherein the door hinge is attached to the left or right side of the door frame and a top-bottom opening and closing method wherein the door hinge is attached to the top or bottom side of the door frame.

On the other hand, the top-bottom opening and closing door hinge is used in electronic appliances such as gas oven or microwave oven and a related art, Korean Patent Office Registration Patent Publication No. 10-1480240 (hereinafter related art).

The related art discloses a door hinge that can be lowered when the door is open to the front.

However, when implementing the door hinge structure of the related art to an oven stove, it is clear that this is a useful design that prevents interference between the door and the door frame by allowing the door to open through a hinged door, and the opening operation is performed at a certain distance, in the prior art, after the door is completely laid forward and the opening operation is completed, the inner side surface of the door must be higher than the bottom surface of the cooking space of the oven range. In the process of taking out cooked food from the cooking space, there is a frequent occurrence of a safety accident, such as spilling of food by hitting the a container for the food on the door Moreover, the door hinge of the related art has a structure in which the speed is gradually increased while an opening of the door is in progress, so unless a separate speed attenuating means is provided, the door is opened too rapidly to cause a noise and damage due to impact.

DETAILED DESCRIPTION

Technical Problem

Therefore, object(s) of the present invention for solving the above problems is to provide a door hinge for an oven that is laid forward and that a position of an inner side surface of the door is lower than the bottom of the interior space of the oven, when opening operation is finished.

Means for Solving the Problem

A door hinge for opening and closing a door, the door hinge comprising:

a fixing member fixed to the door frame of the oven range; an operating frame that is rotatably connected to the fixing member and is fixed to the door to open and close the door; a plate bolted in close contact with the lower inner side of the operating frame; and a hinge bracket configured to rotatably connecting the operating frame to the fixing member, wherein the hinge bracket comprises a plate that is bolted in close contact with the inside of the lower end of the operating frame and a gap holding member composed of a hinge shaft at the bottom of the fixing member in a state in which the space is formed in the center in a shape of a "U" cross-section, the front end is configured to be coupled to the lower end of the plate, and its end is exposed to the outside of the lower end of the operating frame.

According to aspect(s) of the present invention, a link is provided, which may include a link rod a link rod having an end coupled to the fixing member with a first pin; and a link slide, which is coupled to an end of the link rod and moves along the guide length groove according to the rotational movement of the operating frame while being fitted in an elongate guide groove formed inside the operating frame.

It is preferable that the protrusion is formed at a upper side of the link slider, and a stumbling protrusion colliding with the protrusion is formed at the inner upper side of the operating frame according to the rotational movement of the operating frame.

Effects of Invention

According to aspect(s) of the present invention, when the operating frame installed in a door is connected to a fixing member installed on a door frame of the door with a hinge shaft, by connecting a hinge bracket as a medium, the door may be laid forward so that an inner side surface of the door, when the opening operation is completed, is lower than a bottom surface of an interior space of the oven range. It has the effect of being safely removed.

By laying forward and allowing the inner side surface of the door, which has been opened to open, to be located lower than the bottom surface of the interior space of the oven, it has the effect of safely removing it without hitting the door in the process of removing the container for food from the oven.

The inner side surface of the door can be positioned lower than the bottom surface of the interior space of the oven if the opening operation is completed by being laid down forward due to a thickness of the door.

By doing so, it has an effect of safely removing without bumping into the door in the process of removing the the container for food from the oven stove.

In addition, by attenuating the closing speed of the door at any point where the closing operation of the door is made, it has an effect of preventing the door from colliding with the door frame of the oven stove and causing damage or severe noise.

BRIEF DESCRIPTIONS OF THE DRAWINGS

Example embodiments of the present invention will become more apparent by describing example embodiments of the present invention in detail with reference to the accompanying drawings, in which.

EMBODIMENT OF INVENTION

Figure 1:
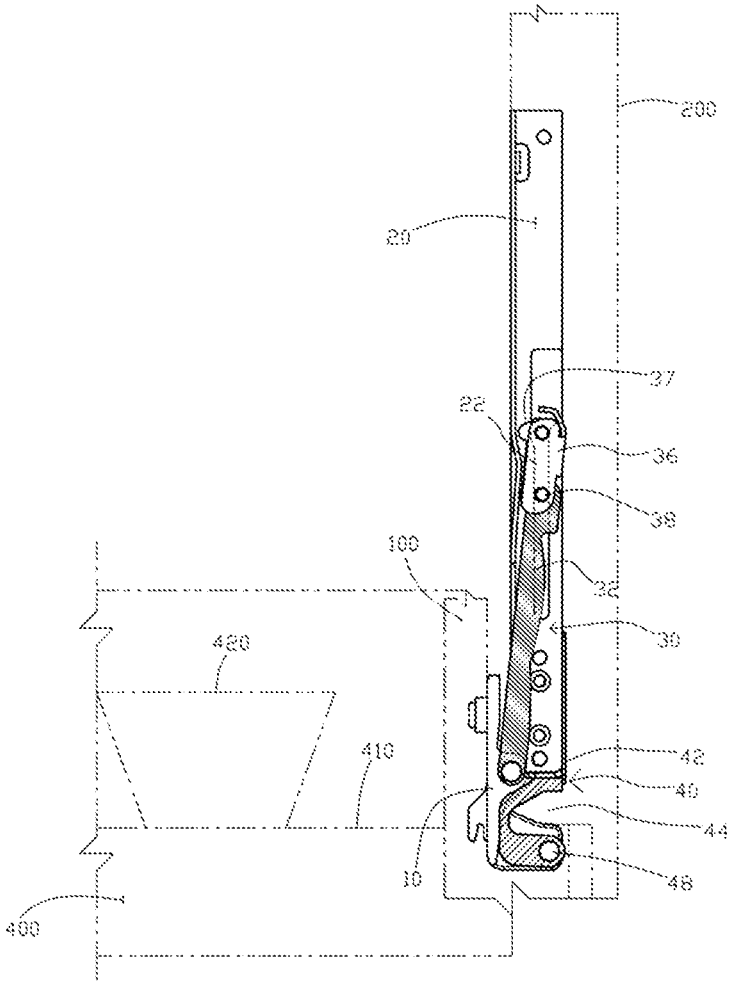
FIG. 1 is a view showing the configuration of a door hinge according to an embodiment of the present invention.

While the present invention is susceptible to various modifications and alternative embodiments, specific embodiments thereof are shown by way of example in the drawings and will be described. However, it should be understood that there is no intention to limit the present invention to the particular embodiments disclosed, but on the contrary, the present invention is to cover all modifications, equivalents, and alternatives falling within the spirit and scope of the present invention.

It will be understood that, although the terms first, second, etc. may be used herein to describe various elements, the elements should not be limited by the terms. The terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items It will be understood that when an element is referred to as being "connected" or "coupled" to another element, it can be directly connected or coupled to another element or intervening elements may be present. In contrast, when an element is referred to as being "directly connected" or "directly coupled" to another element, there are no intervening elements present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms and used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments of the present invention will be described with reference to the accompanying drawings in detail. For better understanding of the present invention, same reference numerals are used to refer to the same elements through the description of the figures, and the description of the same elements will be omitted.

Figure 2:
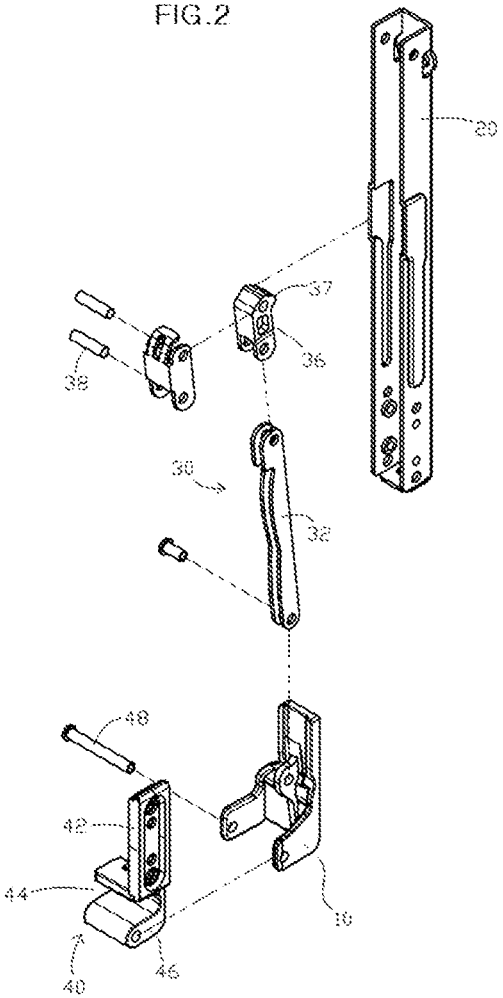
FIG. 2 is a three-dimensional excerpt of the main configuration of the door hinge of FIG. 1.
Figure 3:
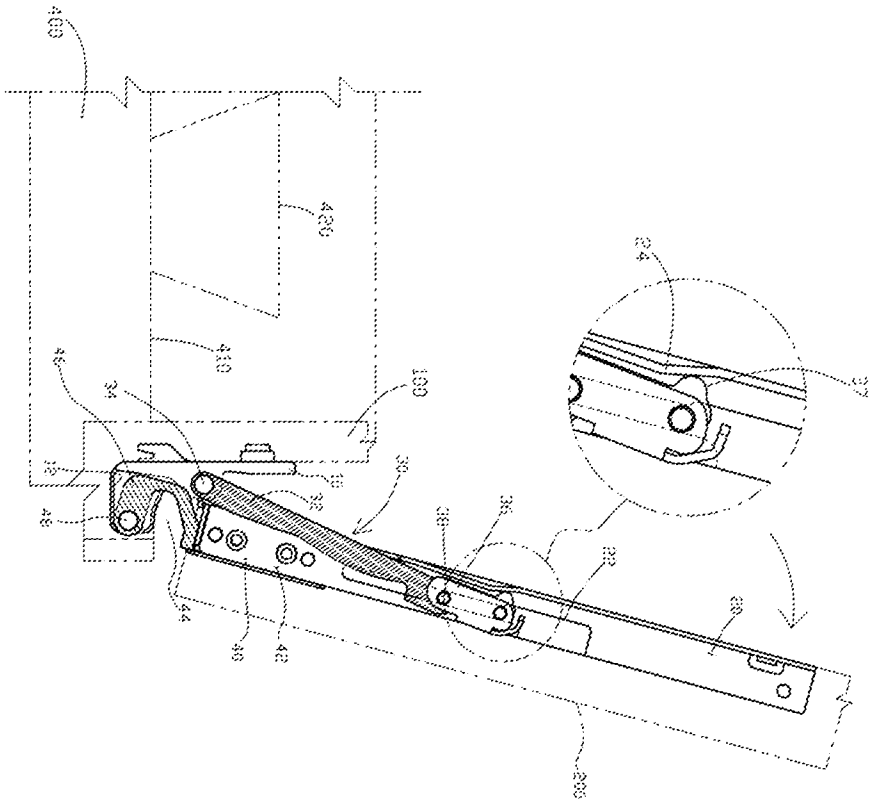
FIG. 3 is a view showing a state in which the closing of the door according to an aspect of the present invention.
Figure 4:
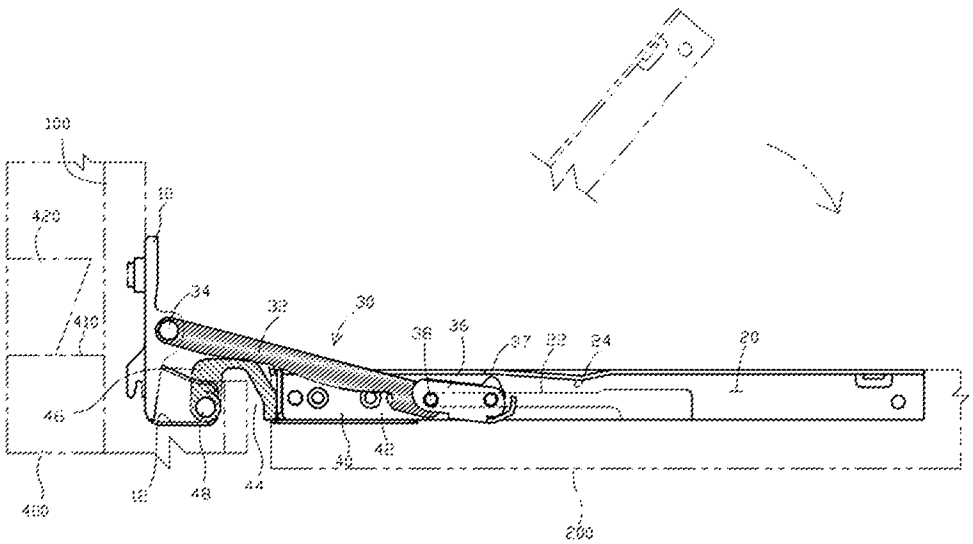
FIG. 4 is a view showing a state in which the door opening operation using the door hinge according to an aspect of the present invention.

FIG. 1 is a view showing the configuration of a door hinge according to an embodiment of the present invention and FIG. 2 is a three-dimensional excerpt of the main configuration of the door hinge of FIG. 1.

As shown in FIGS. 1 and 2, the door hinge according to aspect(s) of the present invention is to be installed in various home appliances (oven range) that allows the door 200 to be opened and closed in a top and bottom opening and closing method hinged by a bottom side (that is, a way to be opened and closed at the front).

A door hinge may include a fixed member 10 mounted on the door frame 100, an operating frame 20 mounted on the door 200 and configured to be connected to the fixed member 10 and the hinge bracket 40 and the fixed member 10, a linker 30 for connecting the operating frame 20 and guiding the rotational operation of the operating frame 20 to be stably performed.

The operating frame 20 is configured to be connected to the fixing member 10 and the hinge bracket 40 in a state mounted on the door 200, and connects the hinge bracket 40 and the fixing member 10. The operating frame 20 is an apparatus for opening the door 200 by rotating about a hinge shaft 48, which connects the hinge bracket 40 and the fixing member 10.

In other word, the fixing plate 12 formed on the both lower side of the fixing member 10. The hinge bracket 40 is connected to the fixing member through the fixing plate 12 using the hinge shaft 48.

The linker 30 is a member that guides the rotation operation of the operating frame 20 according to the opening of the door 200 to be stably performed.

The linker 30 may include a link rod 32 which has a first end and the second end thereof. The first end of the link rod 32 is coupled to the fixing member 10 with a pin 34, The link slider 36, which is coupled to the second end of the link rod 32 by a pin 38, which guides the rotation of the operating frame 20 while moving on an elongate guide groove 22, and is inserted into the elongate guide groove 22 formed inside the operating frame 20 according to the rotational movement of the operating frame 20.

A protrusion 37 is formed at an upper end of the link slider 36, and a stumbling protrusion 24 formed on the inner upper end of the operating frame 20 hits the protrusion 37 and attenuates the closing speed of the door 200 so that the door 200 is not closed suddenly.

That is, when the door 200 is lifted to close the door 200, which is opened, the operating frame 20 rotates in an opposite direction to the opening of the door 200 and causes the door 200 to be closed. At this time, when the rotation of the operating frame 20 reaches approximately 70° from the opening of the door 200, as the stumbling protrusion 24 formed on the inner upper end of the operating frame 20 bumps into the protrusion 37 of the link slider 36, the closing speed of the door 200 is attenuated to prevent the door 200 from colliding with the door frame 100 of the oven stove 400 or being damaged or generating severe noise.

One end of a main spring (not shown) is fixed to the operating frame 20 and the other end of the main spring (not shown) is configured to be connected to the link slider 36 to elastically support the rotational movement of the operating frame 20.

A hinge bracket 40 is a member that rotatably connects the operating frame 20 to the fixing member 10.

The hinge bracket 40 may include: a plate 42 that is bolted in close contact with the inside of the lower end of the operating frame 20, and a gap holding member 46 has a space 44 is formed in a center in a "U" cross-sectional shape, a front end, is configured to be coupled to the lower end of the plate 42, and a rear end thereof is coupled to, while being exposed outside the lower end of the operating frame 20, the fixing plate 12 formed on both sides of the lower end of the fixing member 10.

However, a gap holding member may be not only "U" shape but also "C" or different shape as long as a shape having a space in the center thereof. the gap holding member 46 enables the hinge shaft 48 to be coupled to the bottom of the fixing member 10 as much as possible at a distance of the space 44 formed in the center thereof.

That is, while rotating the operating frame 20 around the hinge shaft 48, the door 200 is completely laid forward in a process of opening the door 200, at the time when the opening operation is completed, an inner side surface of the door 200 is positioned to be lower than the bottom surface 410 of the cooking space of the oven 400.

Thus, in a process of pulling out the container for food 420 supporting the food being cooked in the cooking space to the outside, it is possible to prevent a safety accident risk such as spilling food due to the container for food 420 hitting the door 200.

That is, for an example, if an lower end of the operating frame 20 is directly coupled to the fixing member 10 by a hinge shaft 48, even if an opening operation of the door 200 is completed, an inner side surface of the door 200 must be higher than a bottom surface 410 of the cooking vessel of the oven stove 400 due to a thickness of the door 200.

Thus, in this case, in the process of taking out the food supporter 420 from the oven stove 400 to the outside, there is a risk that the food supporter 420 may hit the door 200 and may cause to spill the food.

However, according to aspect(s) of the present invention, when the gap holding member 46 of the hinge bracket 40 is interposed between the operating frame 20 and the fixing member 10, the operating frame 20 is combined to the fixing member 10 by the hinge shaft 48, since the hinge shaft 48 can be coupled to the bottom of the fixing member 10 as much as the distance of the space 44 of the gap holding member 46.

Thus, regardless of the thickness of the door 200, an inner side surface of the door 200 can be positioned lower than the bottom surface 410 of the cooking space of the oven 400 if the opening operation is completed, thereby preventing the support 420 from colliding with the door 200 according to aspect(s) of the present invention.

While the example embodiments of the present invention and their advantages have been described in detail, it should be understood that various changes, substitutions and alterations may be made herein without departing from the scope of the present invention.

| [EXPLANATION OF SYMBOLS] | |
|---|---|
| 10: fixing member | 20: operating frame |
| 30: linker | 32: link rod |

-continued

| [EXPLANATION OF SYMBOLS] | |
|---|---|
| 36: link slider | 40: hinge bracket |
| 42: plate | 44: space |
| 46: gap holding member | 48: hinge shaft |
| 100: door frame | 200: door |
| 400: oven range | 410: bottom surface |

What is claimed is:

1. A door with a door hinge for opening and closing the door for an oven range, the door comprising:

a door frame; and the door hinge attached to the door, wherein the door hinge comprises:

a fixing member fixed to the door frame of the oven range;

an operating frame that is rotatably connected to the fixing member and is fixed to the door to open and close the door;

a hinge bracket configured to rotatably connect the operating frame to the fixing member, wherein the hinge bracket comprises:

a plate connected in close contact with an inside of a lower end of the operating frame by a bolt, a gap holding member having a first end, a second end, and in a shape of a "U" cross-section at a center thereof for forming a space, and a hinge shaft configured to couple the gap holding member and the fixing member, wherein the first end of the gap holding member is directly connected to a lower end of the plate, and the second end of the gap holding member is directly connected to a lower end of the fixing member by the hinge shaft, wherein the gap holding member is connected to a lower end of the fixing member through a fixing plate, while being exposed to an outside of the lower end of the operating frame, a linker, wherein the linker comprises:

a link rod having a first end and a second end, wherein the first end of the link rod is directly coupled to the fixing member by a first pin;

a link slider configured to move along an elongate guide groove formed inside the operating frame, according to a rotational movement of the operating frame, wherein the link slider has a first end and a second end, the first end of the link slider is directly coupled to the second end of the link rod by a second pin and the second end of the link slider is movably inserted in the elongate guide groove of the operating frame, a protrusion formed at the second end of the link slider, and a stumbling protrusion formed at an upper end of an inner side of the operating frame and configured to collide with the protrusion according to the rotational movement of the operating frame for attenuating a closing speed of the door with respect to the door frame.

* * * * *